US006910923B2

(12) United States Patent
Nakanishi

(10) Patent No.: US 6,910,923 B2
(45) Date of Patent: Jun. 28, 2005

(54) FUSE MODULE

(75) Inventor: Ryuji Nakanishi, Nagoya (JP)

(73) Assignees: Autonetworks Technologies, Ltd., Nagoya (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 519 days.

(21) Appl. No.: 10/006,661

(22) Filed: Dec. 10, 2001

(65) Prior Publication Data

US 2002/0076983 A1 Jun. 20, 2002

(30) Foreign Application Priority Data

Dec. 15, 2000 (JP) ..... 2000-382673
Jan. 11, 2001 (JP) ..... 2001-003340

(51) Int. Cl.[7] ..... H01R 13/68

(52) U.S. Cl. ..... 439/621; 439/76.2; 439/724; 439/718

(58) Field of Search ..... 439/621, 76.2, 439/724, 718

(56) References Cited

U.S. PATENT DOCUMENTS 5,285,011 A * 2/1994 Shimochi
5,795,193 A * 8/1998 Yang
6,227,913 B1 * 5/2001 Davis et al.
6,280,253 B1 * 8/2001 Kraus et al.

FOREIGN PATENT DOCUMENTS

| | | |
|---|---|---|
| JP | 58-117047 U | 8/1983 |
| JP | A 59-23430 | 2/1984 |
| JP | A 61-142623 | 6/1986 |
| JP | A 2000-182506 | 6/2000 |

* cited by examiner

*Primary Examiner*—Truc Nguyen
(74) *Attorney, Agent, or Firm*—Oliff & Berridge

(57) ABSTRACT

A plurality of fuses in each of which an input terminal and an output terminal are integrally connected with the opposite ends of a fusing element are provided inside an insulating fuse casing, the respective output terminals are so arranged as to be electrically connectable with tab terminals of busbars via tab terminal insertion holes formed to penetrate a casing main body from inside to outside (at the bottom), and the respective input terminals are so arranged as to be electrically connectable with tab terminals of the busbars via tab terminal insertion holes formed to penetrate the casing main body from inside to outside (at the bottom). A fuse module enabling an electrical connection box to be smaller and lighter can be provided.

18 Claims, 12 Drawing Sheets

FUSE MODULE

BACKGROUND OF THE INVENTION

This invention relates to a fuse module to be assembled into an electrical connection box used for, e.g., an automotive vehicle and the like.

A known electrical connection box has a fuse mounting section 301 which is formed on an outer surface of a casing 300 and in which a multitude of fuses are mounted as shown in FIG. 12. Further, a fuse in which connection terminals 312 connected with the opposite ends of a fusing element 311 are covered by an insulating member 314 except their leading ends as shown in FIG. 13 is known as a fuse 310 to be mounted in the fuse mounting section 301.

Such a fuse 310 is mounted in the fuse mounting section 301 by inserting the connection terminals 312 of the fuse 310 into forked inserting portions 303 of tab terminals 302 formed at the leading ends of a busbar provided in the fuse mounting section 310 as shown in FIG. 14.

In recent years, automotive vehicles have been demanded to have comfortable equipments while being demanded to improve its comfort in a passenger's compartment. In order to simultaneously satisfy these contradictory demands, electrical connection boxes used in automotive vehicles need to be smaller and more lightweight while circuits for the comfortable equipments are on the increase.

However, as the comfortable equipments increase as described above, the number of fuses for protecting the equipments from an overcurrent tends to increase. Further, the insulating member 314 of the fuse projects above the tab terminals 302 as shown in FIG. 14 to thereby make a conventional fuse mounting structure bulky. This hinders the electrical connection boxes from becoming smaller and more lightweight.

SUMMARY OF THE INVENTION

It is an object of the present invention to provide a fuse module which is free from the problems residing in the prior art.

According to an aspect of the present invention, a fuse module comprises a plurality of fuses each having a fusing element and terminal sections at opposite ends of the fusing element, and a fuse casing for accommodating all of these plurality of fuses. The fuse casing is made of an insulating material, and formed with external terminal insertion holes.

These and other objects, features and advantages of the present invention will become more apparent upon a reading of the following detailed description and accompanying drawings.

DETAILED DESCRIPTION OF THE PREFERRED EMBODIMENTS OF THE INVENTION

Figure 1:
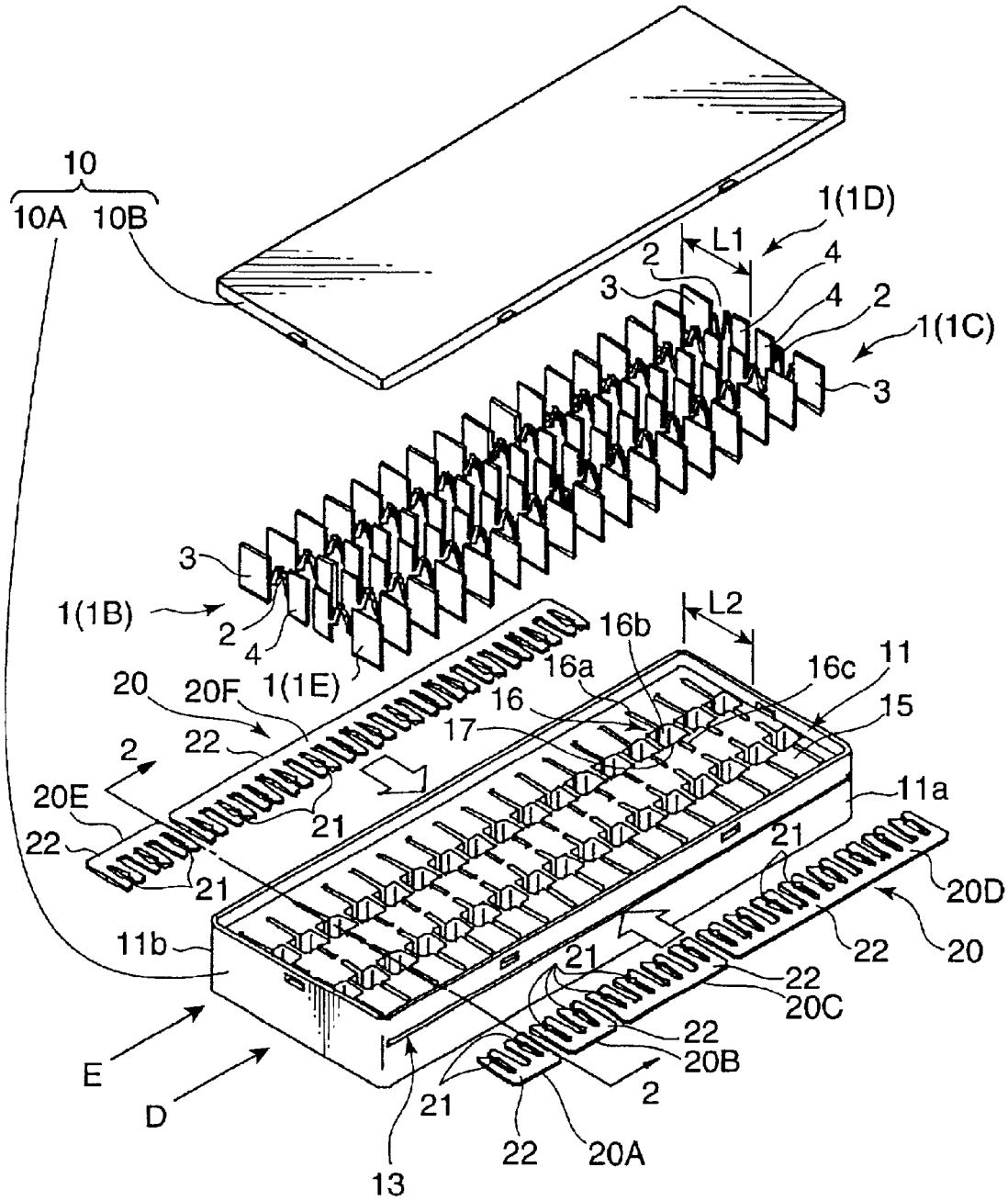
FIG. 1 is an exploded perspective view showing a fuse module according to a first embodiment of the invention.

Referring to FIGS. 1 to 4 showing an embodiment of the present invention, a fuse module is comprised of an insulating fuse casing 10, a plurality of fuses 1 provided in the fuse casing 10, and shorting members 20 mounted in the fuse casing 10.

Each fuse 1 has a plate-shaped construction in which an input terminal 3 and an output terminal 4 are integrally connected with the opposite ends of a fusing element 2, and is entirely made of an electrically conductive material. The input terminals 3 and the output terminals 4 are both substantially in the form of a rectangle, and the input terminals 3 have the same height as the output terminals 4, but are wider than them. The shape, width and the like of the fusing elements 2 are adjusted according to their fusing characteristics, i.e., fuse capacities. For example, the fusing elements 2 of the fuses 1B are convex, whereas those of the fuses 1C are sinuous like an ac signal waveform. The fuses 1D are mirror images of the fuses 1C.

The fuse casing 10 is formed with an opening 11 and shorting member insertion holes 13, 14, and includes a casing main body 10A and a cover 10B for closing the opening 11. Fuse mount holes 16 are formed inside a base portion 15 exposed at the opening 11 of the casing main body 10A.

A plurality of fuse mount holes 16, seventeen in the shown example, are arrayed at specified intervals in each of two rows D, E shown in FIG. 1 along the longitudinal direction of the casing main body 10A in the form of a rectangular parallelepiped. Each mount hole 16 is so formed that the plate-shaped fuse 1 can be vertically mounted, i.e., with the bottom ends of the input and output terminals 3, 4 faced down, and is comprised of an input terminal mounting portion 16*a* in which the input terminal 3 is mounted, a fusing element mounting portion 16*b* in which the fusing element 2 is mounted, and an output terminal mounting portion 16*c* in which the output terminal 4 is mounted, the portions 16*a*, 16*b* and 16*c* being continuous in horizontal direction. Distance L2 between the outer end of the input terminal mounting portion 16*a* and the outer end of the output terminal mounting portion 16*c* is set substantially equal to distance L1 between the opposite ends of the fuse 1. The input terminal mounting portion 16*a* is formed longer than the output terminal mounting portion 16*c* in view of the fact that the input terminal 3 is wider than the output terminal 4.

At an upper edge of each fuse mount hole 16, an opening 17 communicating with the input terminal mounting portion 16*a*, the fusing element mounting portion 16*b* and the output terminal mounting portion 16*c* is defined in the base portion 15. In both rows D and E, the input terminal mounting portions 16*a* are arranged at the sides closer to the outer surfaces of the casing main body 10A. In other words, the input terminal mounting portions 16*a* of the row D and those of the row E extend in opposite directions.

Further, the width of the input and output terminal mounting portions 16*a*, 16*b* is substantially equal to that of the plate-shaped fuses 1, so that the input and output terminals 3, 4 at the opposite sides of the fuses 1 can be securely held without shaking. Further, the width of the fusing element mounting portions 16*b* is set sufficiently larger than that of the plate-shaped fuses 1, so that clearances are defined at the opposite sides of the fuses 1 mounted in the fuse mounting holes 16. Thus, the mounted fuses 1 can be easily taken out using these clearances.

Figure 2:
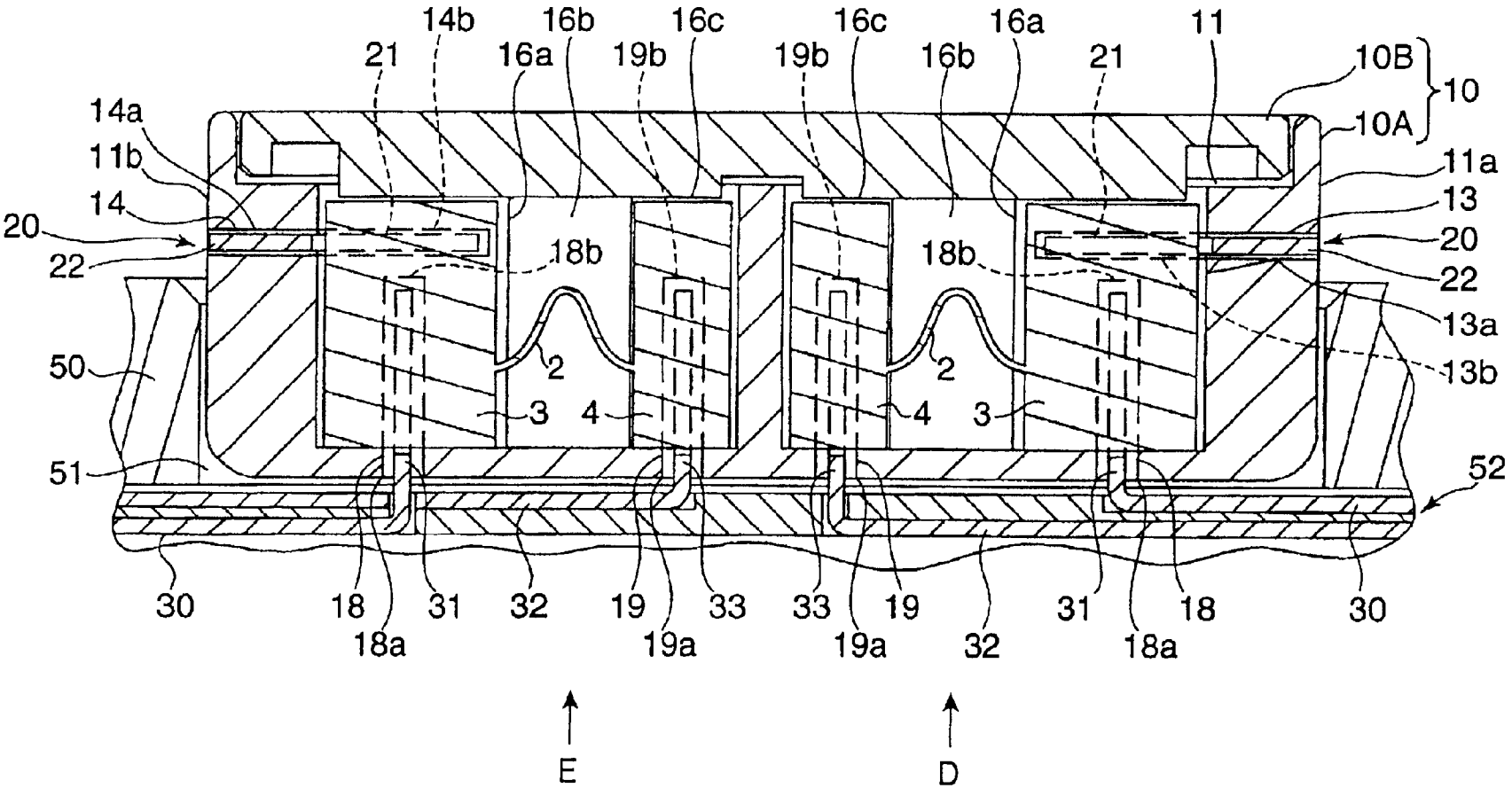
FIG. 2 is a section view along the line 2—2 in FIG. 1.
Figure 3:
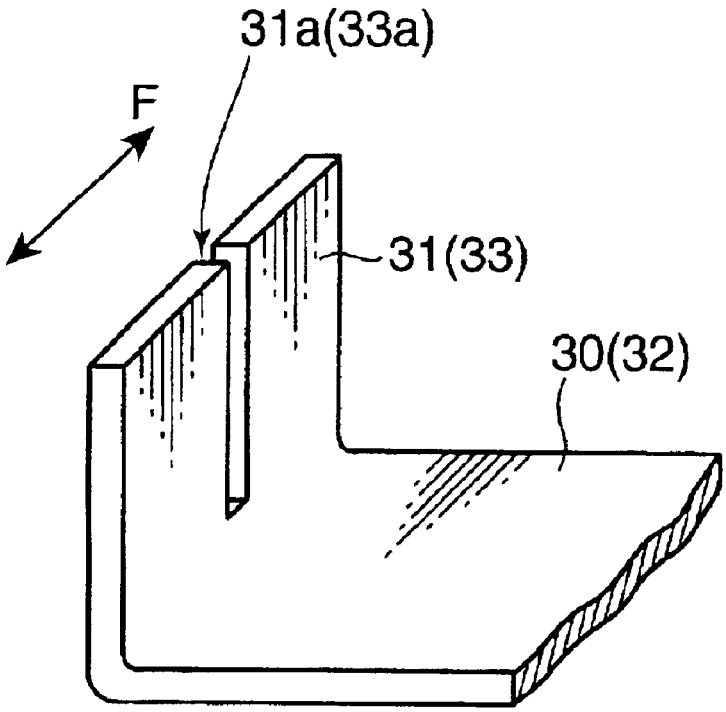
FIG. 3 is a perspective view showing part of a busbar having a tab terminal to be connected with an input/output terminal of the fuse module.
Figure 4:
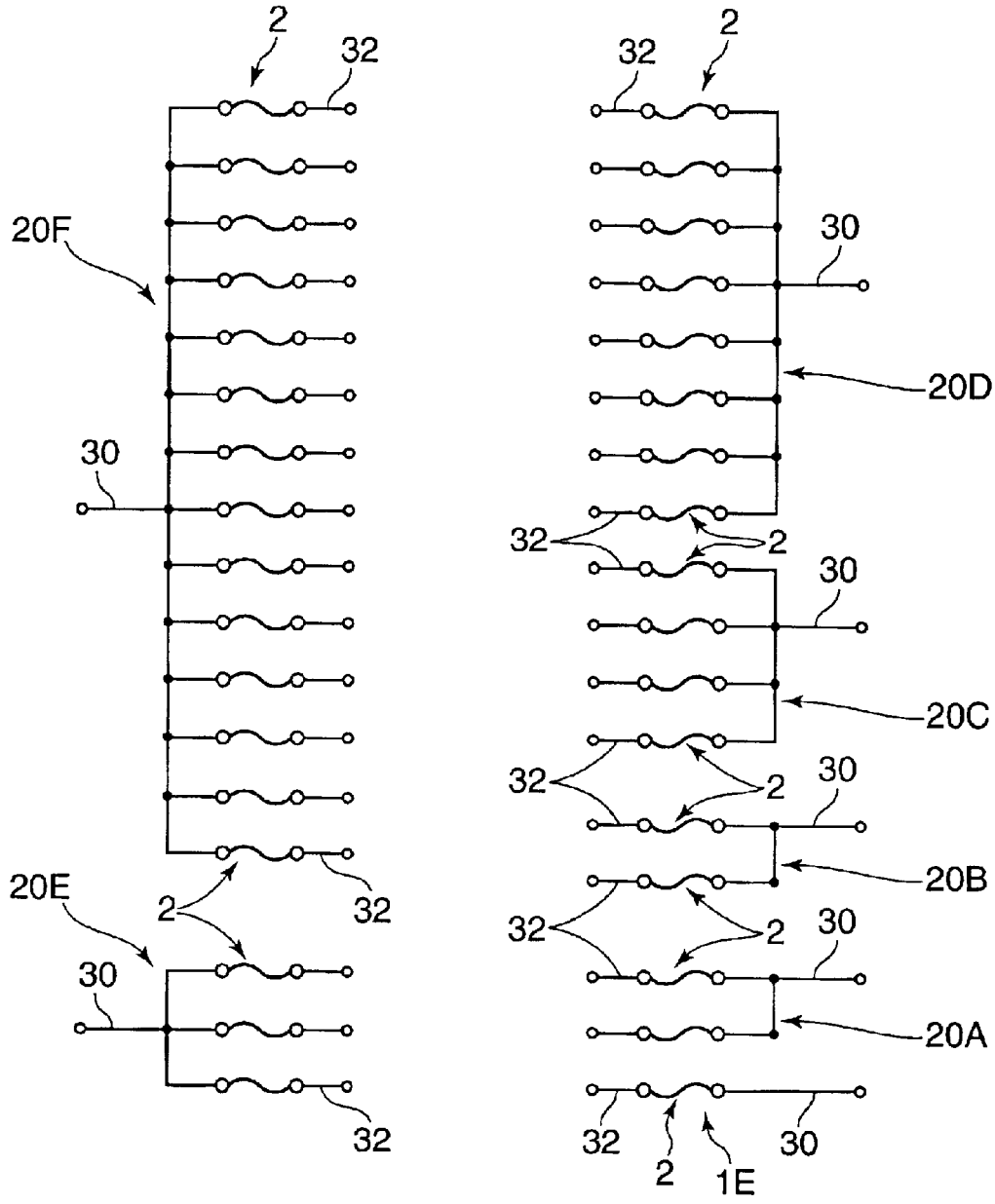
FIG. 4 is an equivalent circuit diagram of a fuse circuit formed by the fuse module.

As shown in FIG. 2, the fuses 1 are individually mounted in the respective fuse mount holes 16, which are formed with tab terminal insertion holes 18, 19 as external terminal insertion holes. The tab terminal insertion hole 18 is for an input tab terminal and a tab terminal 31 formed by bending an end of an input-side busbar 30 is inserted thereinto, and the tab terminal insertion hole 19 is for an output tab terminal and a tab terminal 33 formed by bending an end of an output-side busbar 32 is inserted thereinto. Each tab terminal 31, 33 is formed with a forked inserting portion 31*a*, 33*a* in its center along widthwise direction (F) as shown in FIG. 3.

The tab terminal insertion hole 18 is so formed as to have the same horizontal cross section from its opening 18*a* to its inner back 18*b*, and intersects with, e.g., is normal to the input terminal mounting portion 16*a*. The other tab terminal insertion hole 19 is also so formed as to have the same horizontal cross section from its opening 19*a* to its inner back 19*b*, and intersects with, e.g., is normal to the output terminal mounting portion 16*c*.

Accordingly, when the tab terminals 31, 33 are inserted through the respective tab terminal insertion holes 18, 19 as described later, the input terminal 3 of the fuse 1 is inserted into the forked inserting portion 31*a* of the tab terminal 31 to connect the input-side busbar 30 and the input terminal 3, whereas the output terminal 4 of the fuse 1 is inserted into the forked inserting portion 33*a* of the tab terminal 33 to connect the output-side busbar 32 and the output terminal 4. Although the tab terminals 33 of the output-side busbar 32 are mounted into all the fuse mount holes 16, the tab terminals of the input-side busbar 30 are mounted into part of the fuse mount holes 16. This is described later.

As shown in FIGS. 1 and 2, the shorting member insertion hole 13 is horizontally formed from the side surface 11*a* of the casing main body 10A at the side of the row D, whereas the shorting member insertion hole 14 is horizontally formed from the side surface 11*b* of the casing main body 10A at the side of the row E. A plurality of shorting members 20 made of an electrically conductive material, e.g., four shorting members 20A, 20B, 20C and 20D are inserted into the shorting member insertion hole 13, whereas a plurality of shorting members 20, e.g., two shorting members 20E and 20F are inserted into the shorting member insertion hole 14 (see FIG. 1).

The shorting members 20A, 20B are both constructed such that two comb-shaped press-contact blades 21 are provided at a coupling portion 22; the shorting members 20C and 20E are both constructed such that three comb-shaped press-contact blades 21 are provided at the coupling portion 22; the shorting member 20D is constructed such that eight comb-shaped press-contact blades 21 are provided at the coupling portion 22; and the shorting member 20F is constructed such that fourteen comb-shaped press-contact blades 21 are provided at the coupling portion 2. An interval between adjacent press-contact blades 21 is the same as the interval between adjacent fuse mount holes 16. The shorting members 20A and 20B may have the same construction, and the shorting members 20C and 20E may also have the same construction.

The shorting member insertion holes 13, 14 are comprised of coupling portion inserting portions 13*a*, 14*a* in which the coupling portions 22 are inserted, and blade inserting portion 13*b*, 14*b* in which the press-contact blades 21 are inserted, respectively. The coupling portion inserting portions 13*a*, 14*a* are formed to have a width substantially equal to the length of the casing main body 10A, whereas the blade inserting portions 13*b*, 14*b* are formed to have such a width as to allow one press-contact blade 21 is insertable thereinto. The shorting member insertion hole 13, 14 is such that a plurality of blade inserting portions 13*b*, 14*b* are branched off from one coupling portion inserting portion 13*a*, 14*a*.

When the shorting members 20 are inserted into the thus formed shorting member insertion holes 13, 14, the input terminals 3 are inserted into clearances of all the press-contact blades 21 provided in the shorting members 20 since the intervals between adjacent press-contact blades 21 is the same as the interval between adjacent fuse mount holes 16, with the result that a plurality of input terminals 3 are shorted with each other by the shorting members 20. It should be noted that no press-contact blade 21 of the shorting member 20 is connected with the first fuse 1E of the row D.

The fuse module of this embodiment is completed by mounting the cover 10B to close the opening 11 of the casing main body 10A in which the fuses 1 and the shorting members 20 are mounted as described above and securing it by an adhesive or the like.

When the completed fuse module is mounted in a fuse module mounting section 51 formed by recessing in an electrical connection box 50 as shown in FIG. 2, the input terminals 3 are inserted into the forked inserting portions 31*a* of the tab terminals 31 provided in a connection casing 52 mounted beforehand below the mounting section 51 and projecting upward from the connection casing 52 to be electrically connected while the output terminals 4 are inserted into the forked inserting portions 33*a* of the tab terminals 33 to be electrically connected. This connection is made at once for all tab terminals 31 and all tab terminals 33 by mounting the fuse module in the fuse module mounting section 51. In this way, fuse circuits having equivalent circuits shown in FIG. 4, i.e., circuits in which a plurality of fusing elements 2 and output terminals are connected in parallel with a common power supply is formed. No shorting member 20 is connected with the fuse 1E described above, and the busbars 30, 32 are directly connected with a single input terminal 3 and a single output terminal 4.

In the fuse module according to this embodiment described in detail above, since a plurality of fuses 1 are arranged in the fuse casing 10, it is not necessary to insulate the fuses 1 themselves by insulating members unlike the prior art, the fuse module can be, therefore, lighter by eliminating the need for the insulating members. Further, since the terminals 3, 4 need not be covered by insulating members and it is sufficient for the output terminals 4 to have at least such a size as to be connectable with the tab terminals 33 and for the input terminals 3 to have at least such a size as to be connectable with tab terminals 31 and the shorting members 20, it is possible to reduce the sizes of the terminals 3, 4. As a result, the fuse module can be made smaller.

Since the fuses 1 are individually mounted in the fuse mount holes 16 formed in the insulating fuse casing 10 in the first embodiment, they are insulated from each other. Further, since the fuses 1 are vertically mounted in the fuse mount holes 16, a mounting area can be made smaller, thereby enabling the fuse module to be smaller. Since the width of the terminal mounting portions 16*a*, 16*c* is substantially equal to the thickness of the fuses 1, the fuses 1 can be securely held without shaking by the terminal mounting portions 16*a*, 16*c* located at the opposite ends of the fuses 1. Further, since the spacing between the terminals 3, 4 of the fuses 1 is constant among the fuses 1, desired fuses 1 can be mounted in the fuse mount holes 16. If the fuse capacity is the same, the fuses 1 can be used without being chosen. Furthermore, since the width of the fusing element mounting portions 16*b* is larger than the thickness of the fuses 1, the clearances are formed between the fusing elements 2 of the fuses 1 mounted in the fuse mount holes 16 and the fusing element mounting portions 16*b* and the fuses 1 can be, therefore, easily taken out using these clearances.

In this embodiment, when the shorting member 20 is engaged with a plurality of input terminals 3, the engaged input terminals 3 are shorted with each other since the shorting member 20 is electrically conductive. Thus, it is sufficient to connect at least one of the plurality of shorted input terminals 3 with the tab terminals 31 of the busbar 30, making it possible to simplify the busbar 30. Since the electrically conductive shorting member 20 is engaged with the input terminals 3 arrayed in the same row, a plurality of input terminals 3 are simultaneously engaged and shorted, thereby improving the mountability of the shorting member 20. Further, since each shorting member 20 includes a plurality of comb-shaped press-contact blades 21 engageable with a plurality of input terminals 3 by holding them from opposite sides, the respective press-contact blades 21 and the respective input terminals 3 are simultaneously engaged by pushing the shorting member 20 such that the respective input terminals 3 are inserted into the press-contact blades 21. Thus, the input terminals 3 can be shorted by a simple operation. Furthermore, since a plurality of press-contact blades 21 are provided at the same intervals and the input terminals 3 are arrayed at the same intervals as the press-contact blades 21, it is not necessary to choose the input terminal 3 to be shorted. Further, since the input terminals 3 are arranged to face the outer side of the casing main body 10A and the shorting members 20 are inserted into the casing main body 10A from outside, it is not necessary to provide the shorting members 20 in a narrow space inside the casing main body 10A and a shorting operation by the shorting members 20 can be easily performed.

In the foregoing embodiment, the input terminals 3 of the fuses 1 are wider than the output terminals 4 thereof. This is in consideration of connection of the shorting members 20 with the press-contact blades 21. However, the present invention is not limited to such dimensioning. For example, the input and output terminals 3, 4 are allowed have the same width by shortening the length of the press-contact blades 21. This enables the fuse module to be even smaller.

Although the fuses 1 are linearly arrayed in two rows in the foregoing embodiment, the present invention is not limited thereto. For example, the fuses may be linearly arrayed in one row or may be arrayed along an outer periphery of the fuse casing.

Further, although the numbers of the press-contact blades provided in the shorting members are two, three, four, eight and fourteen in the foregoing embodiment, the present invention is not limited thereto. It should be appreciated that a shorting member having a desired number of press-contact blades may be so used as to conform to a fuse circuit to be designed.

Figure 5:
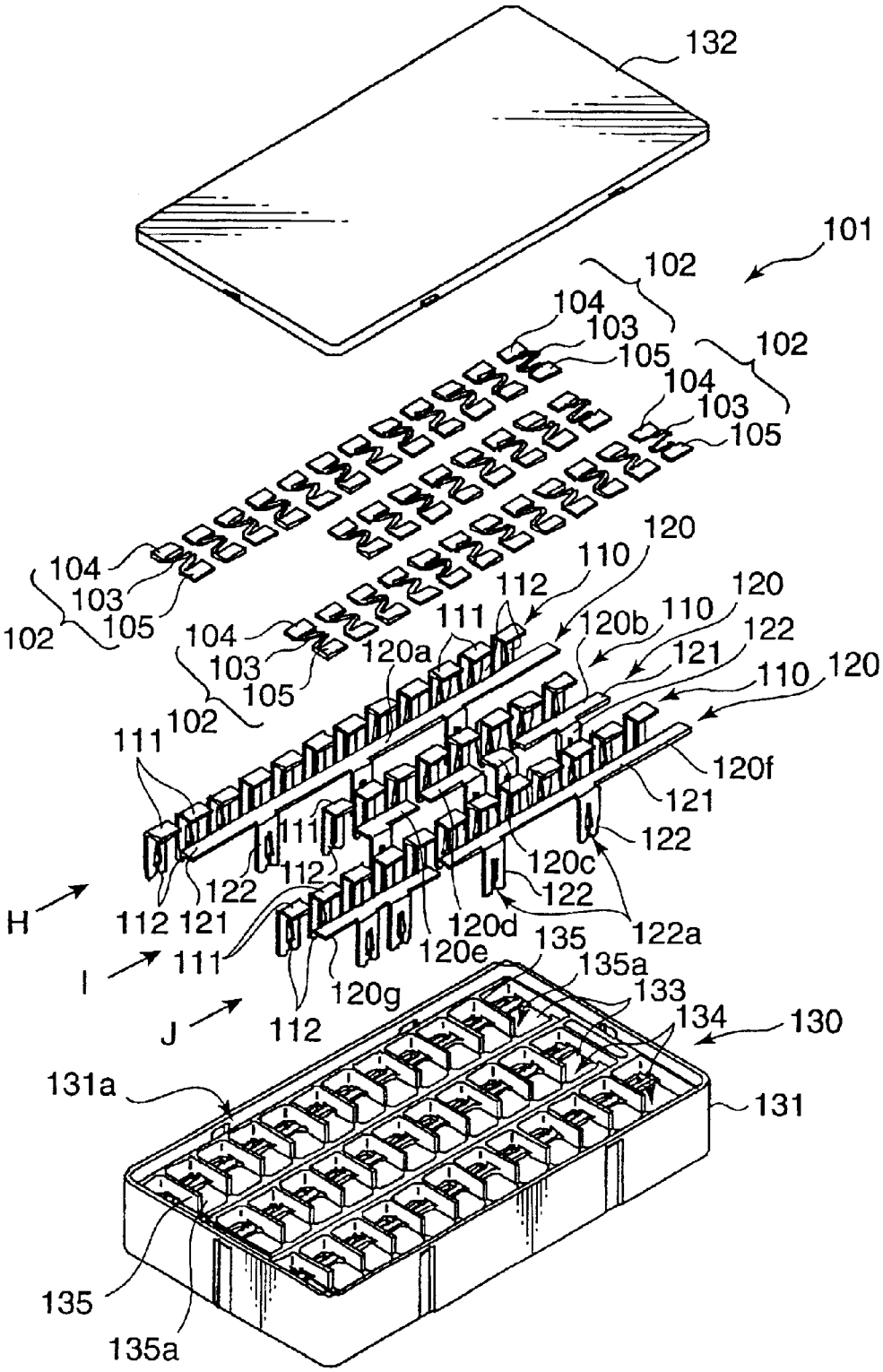
FIG. 5 is an exploded perspective view showing an entire fuse module according to a second embodiment of the invention.
Figure 6:
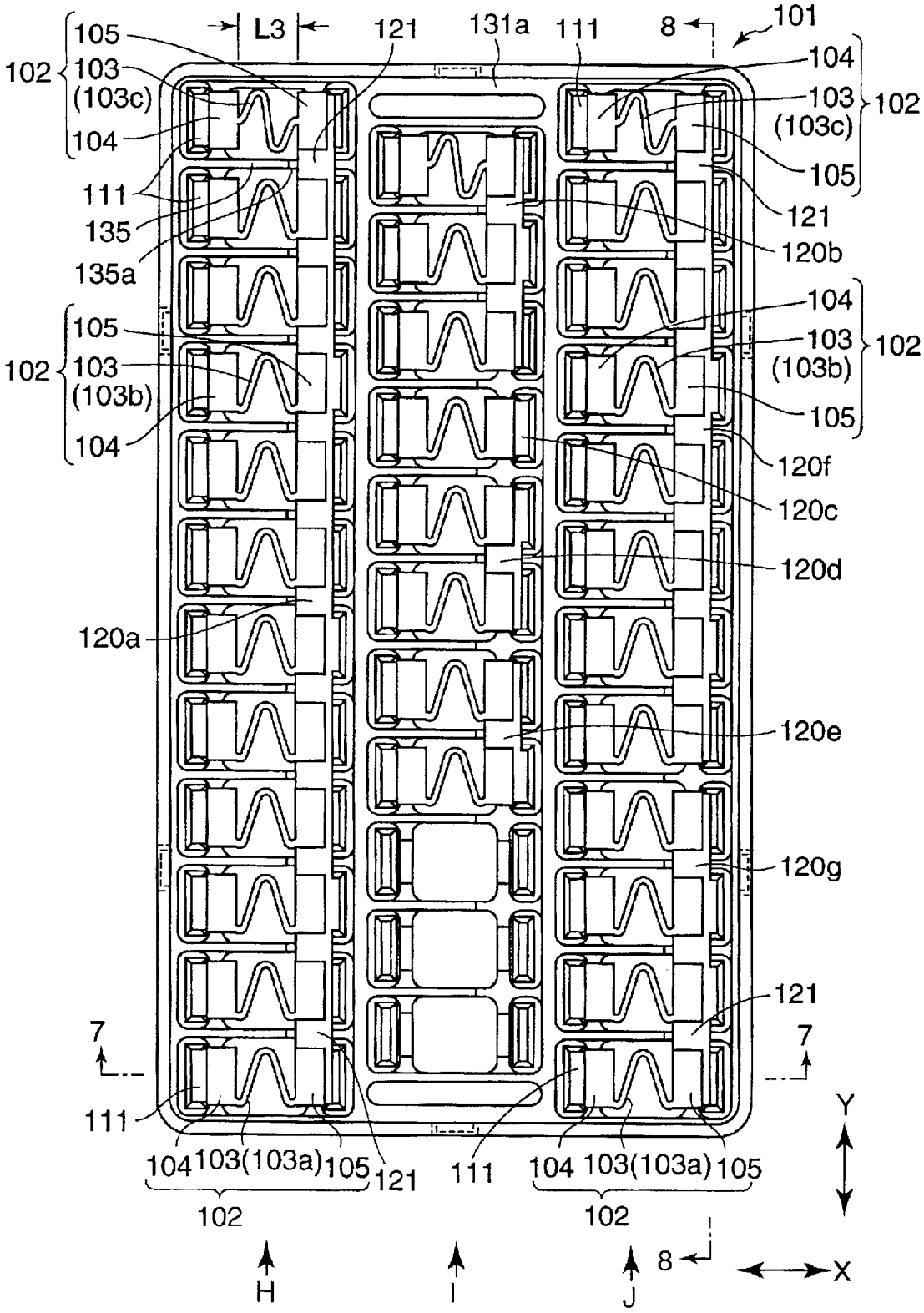
FIG. 6 is a plan view showing the fuse module (without a cover) of FIG. 5.
Figure 7:
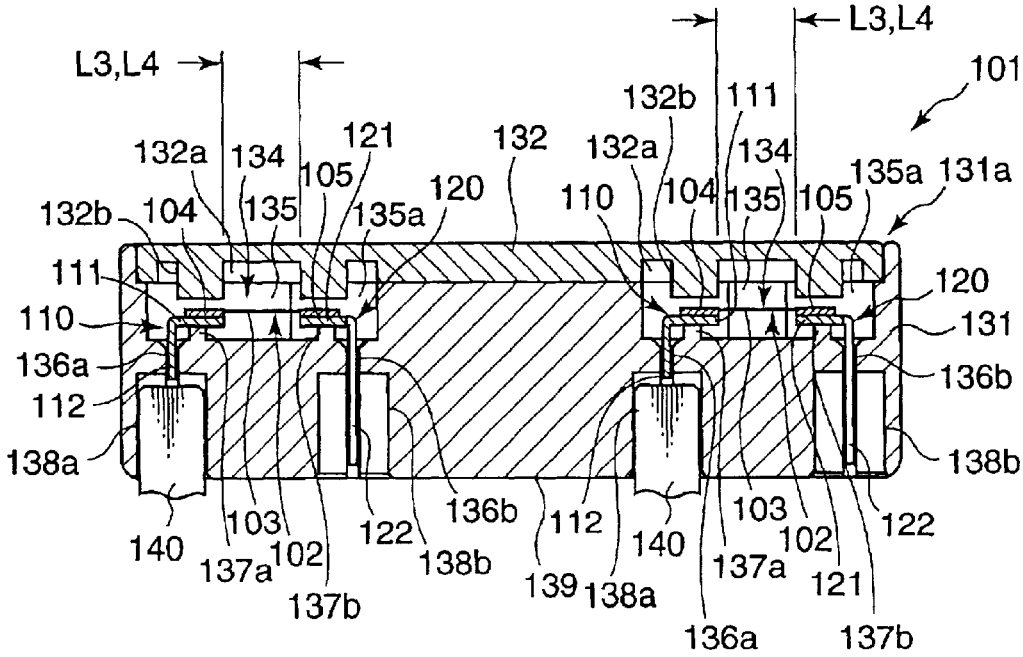
FIG. 7 is a section view along the line 7—7 in FIG. 6.
Figure 8:
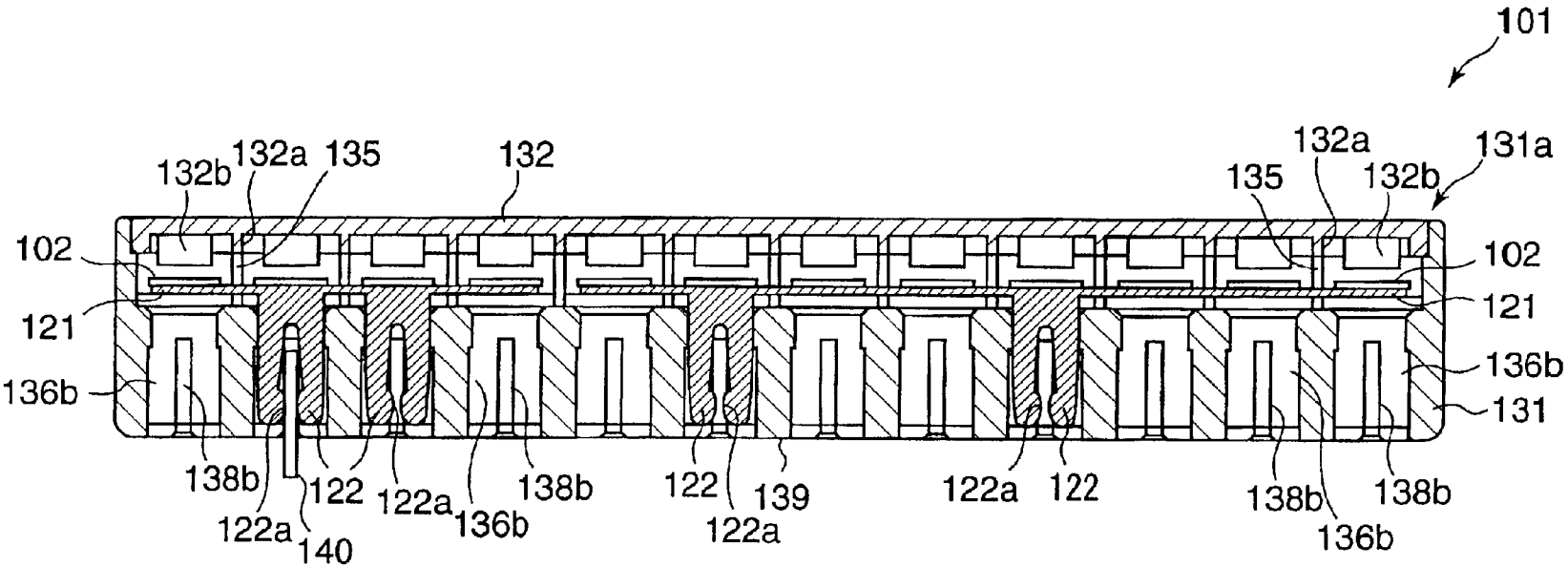
FIG. 8 is a section view along the line 8—8 in FIG. 6.

FIG. 5 is an exploded perspective view showing an entire fuse module according to another embodiment of the invention, FIG. 6 is a plan view showing the fuse module (without a cover) of FIG. 5, FIG. 7 is a section view along the line 7—7 in FIG. 6 and FIG. 8 is a section view along the line 8—8 in FIG. 6. FIGS. 7 and 8 show also the cover.

As shown in FIG. 5, a fuse module 101 is provided with a plurality of fuses 102 each having terminal sections 104, 105 at the opposite ends of a fusing element 103; a plurality of connection terminals (output terminals) 110 formed separately from the fuses 102 and including first connecting portions 111 to be connected with the terminal sections 104 and second connecting portions 112 to be connected with unillustrated external terminals; a plurality of connection terminals (input terminals) 120 formed similarly and including first connecting portions 121 to be connected with the terminal sections 105 and second connecting portions 122 to be connected with unillustrated external terminals; and an insulating fuse casing 130 for accommodating these fuses 102 and connection terminals 110, 120.

Each fuse 102 is made of an electrically conductive metallic material integrally having the fusing element 103 and the terminal sections 104, 105 described above. The fusing element 103 is formed into a desired shape in conformity with its fusing characteristic, i.e., fuse capacity. For example, the fusing elements 103*a* are moderately pointed; the fusing elements 103*b* are steeply pointed; and the fusing elements 103*c* are sinuous, each waveform having a narrow width. The shape and size of the terminal sections 104, 105 are so specified as to be same among the respective fuses 102, and spacing L3 between them is also so specified as to be same among the respective fuses 102.

The fuse casing 130 is comprised of a casing main body 131 having an opening 131*a* and a cover 132 for closing the opening 131*a*, and is made of an insulating material, e.g., an insulating resin. Recesses 134 for mounting the fuses 102 are provided in the casing main body 131 as shown in FIGS. 5, 7 and 8. Three rows of the recesses 134 are arrayed at specified intervals along direction Y, and walls 135 are formed around the recesses 134.

At an inner side of a base wall 133 of each recess 134 are formed connecting portion mount holes 136*a*, 136*b* for mounting the second connecting portion 112 of the output-side connection terminal 110 and the second connecting portion 122 of the input-side connection terminal 122 as shown in FIG. 7. Projections 137*a*, 137*b* for supporting the first connecting portion 111 of the connection terminal 110 and the first connecting portion 121 of the connection terminal 120 are formed near the mount holes 136*a*, 136*b*. The projections 137*a*, 137*b* are provided between the mount holes 136*a* and 136*b*. The mount holes 136*a*, 136*b* and the projections 137*a*, 137*b* constitute connection terminal holding portions. Below the mount holes 136*a*, 136*b*, tab terminal insertion holes 138*a*, 138*b* as external terminal insertion holes are formed to extend in a direction substantially normal to the mount holes 136*a*, 136*b* in plan view and to reach a bottom surface 139.

The connection terminal 110 has one each of the first and second connecting portions 111, 112, wherein the first connecting portion 111 is so bent as to be substantially normal to the second connecting portion 112 and the second connecting portion 112 is formed with a forked inserting portion 112*a*. The connection terminal 110 is mounted in the casing main body 131 by inserting the second connecting portion 112 into the connecting portion mount hole 136*a* until the lower surface of a horizontal portion of the first connecting portion 111 comes into contact with the projection 137*a*. At this stage, the second connecting portion 112*s* are in a state where they are connectable with tab terminals 140 to be described later via the tab terminal insertion holes 138*a*.

On the other hand, the connection terminals 120 include first and second connecting portions 121, 122, wherein the first connecting portions 121 are so bent as to be substantially normal to the second connecting portions 122. Each first connecting portion 121 has its length so adjusted as to be connectable with the connecting portion(s) 105 of one, two or any desired number of fuses 102. For example, the first connecting portion 121 of the connection terminal (120*a*) in left row H shown in FIGS. 5 and 6 has such a length as to be connectable with the terminal sections 105 of twelve fuses 102. The first connecting portions 121 of the connection terminals (120*b*), (120*c*), (120*d*) and (120*e*) from the uppermost to the bottommost position in middle row I have such lengths as to be connectable with the terminal sections 105 of three fuses 102, that of one fuse 102, those of two fuses 102 and those of two fuses 102, respectively. The first connecting portion 121 of the upper connection terminal (120*f*) and that of the lower connection terminal (120*g*) in right row J have such lengths as to be connectable with the terminal sections 105 of eight fuses 102 and those of four fuses 102.

Each connection terminal 120 includes one, two or more second connecting portions 122. For example, as shown in FIG. 5, the connection terminal (120*a*) in the left row H have three second connecting portions 122; each of the connection terminals (120*b*), (120*c*), (120*d*), (120*e*) from the uppermost to the bottommost position in the middle row I has one second connecting portion 122; and each of the upper and lower connection terminals (120*f*), (120*g*) in the right row J has two second connecting portions 122. Further, each second connecting portion 122 is formed with a forked inserting portions 122*a*.

Each connection terminal 120 having the second connecting portion(s) 122 is mounted in the casing main body 131 by inserting the second connecting portion(s) 122 into the connecting portion mount hole(s) 136*a* until the lower surface of a horizontal portion of the first connecting portion 121 comes into contact with the projection 137*b*. At this stage, the second connecting portions 122 are in a state where they are connectable with the tab terminals 140 to be described later via the tab terminal insertion holes 138*b*. It should be noted that portions of the walls 135 are omitted so that the first connecting portions 121 have a specified height, and identified by 135*a* in FIGS. 5 to 7 are these omitted portions of the walls 135. The first connecting portions 111, 121 mounted in the casing main body 131 as described above are located substantially on the same plane (substantially at the same height position) as shown in FIGS. 7 and 8. Further, one mount hole 136*a* and one mount hole 136*b* are provided in each recess 34.

Spacing L4 between the first connecting portions 111 of the connection terminals 110 and the first connecting portions 121 of the connection terminals 120 is equal to the spacing L3 between the terminal sections 104 and 105 of the fuses 102. The shape and size of the first connecting portions 111, 121 are same as those of the terminal sections 104, 105 of the fuses 102.

The terminal sections 104, 105 of the fuses 102 are mounted by, e.g., soldering on the first connecting portions 111, 121 of the connection terminals 110, 120 mounted in the casing main body 131 as described above. The number of the terminal sections 105 corresponding to the first connecting portion 121 is set at a desired value depending on the connection terminal 120 to be used. The mounted fuses 102 are arrayed in three rows at specified intervals in direction Y normal to a spaced-apart direction X of the terminal sections 104, 105 as shown in FIG. 6 and are located substantially on the same plane (substantially at the same height position) as shown in FIGS. 7 and 8.

Figure 9A:
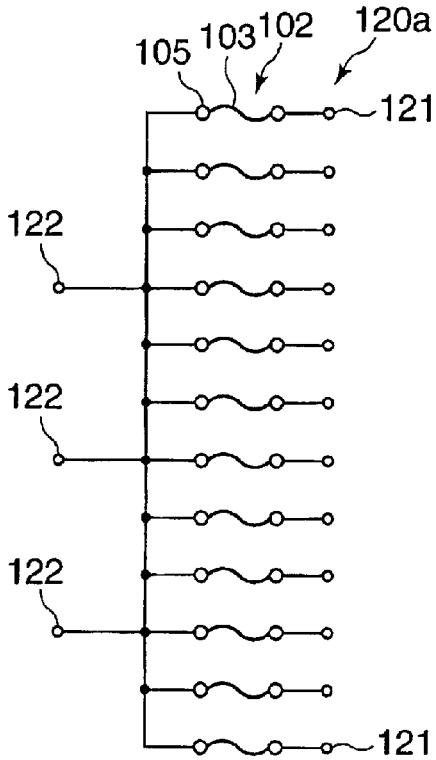
FIGS. 9A to 9C are equivalent circuit diagrams of fuse circuits formed by the fuse module of FIG. 5.
Figure 9C:
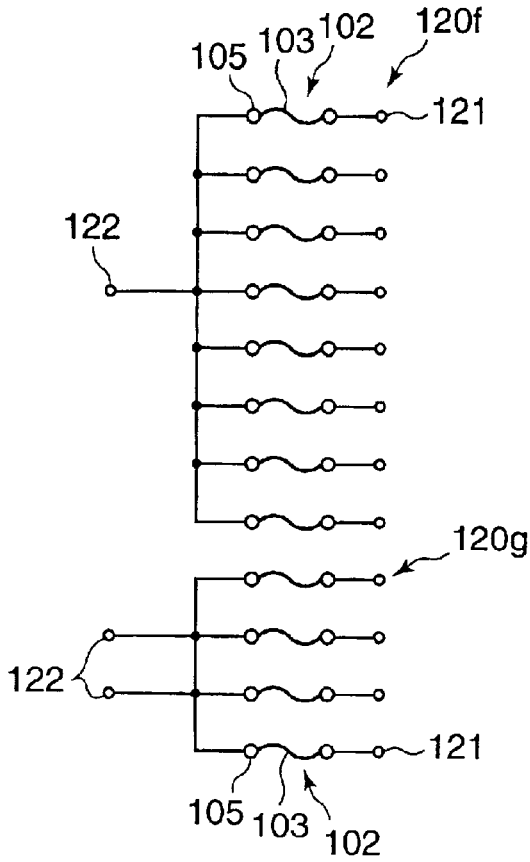
Figure 9B:
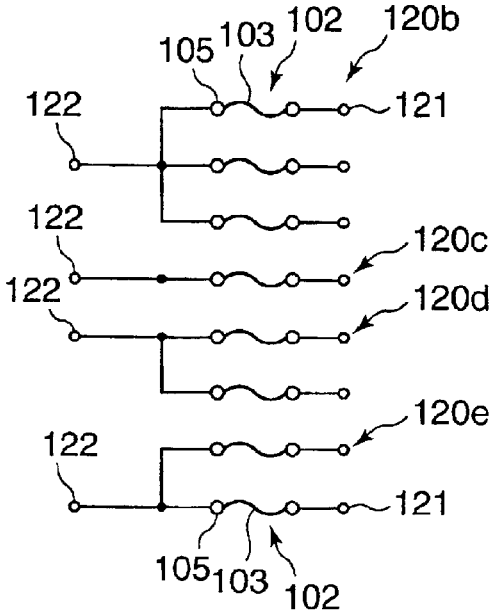

A circuitry of the fuse module in which the connection terminals 110, 120 and the fuses 102 are thus connected forms, for example, fuse circuits shown in FIGS. 9A to 9C. In other words, one connection terminal (120*a*, 120*b*, 120*d*, 120*e*, 120*f*, 120*g*) can be connected with the terminal sections 105 of two or more fuses 102, thereby forming a branched fuse circuit.

The fuse module of the second embodiment is completed when the cover 132 is put on the casing main body 131 in which the connection terminals 110, 120 and the fuses 102 are mounted through the opening 131*a*. Projections 132*a* to be located above the walls 135 and projections 132*b* to be located above the fuses 102 are formed on the inner surface of the cover 132. When the cover 132 is fitted to close the opening 131*a*, it prevents the adjacent fuses 102 from coming into contact with each other to cause a short circuit and prevents the fuse 102 from shifting even if the fuses 102 are displaced, for example, upon being subjected to an external impact or upon being turned upside down.

Figure 10A:
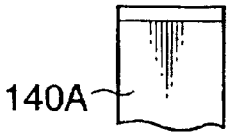
FIGS. 10A to 10C are diagrams showing a mode of a tab terminal with which the fuse module of FIG. 5 is to be connected.
Figure 10B:
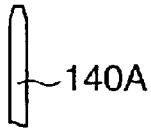
Figure 10C:
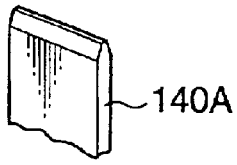
Figure 11A:
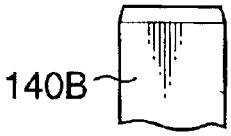
FIGS. 11A to 11C are diagrams showing another mode of a tab terminal with which the fuse module of FIG. 5 is to be connected.
Figure 11B:
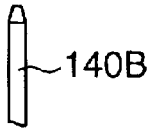
Figure 11C:
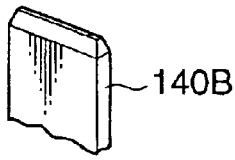
Figure 12:
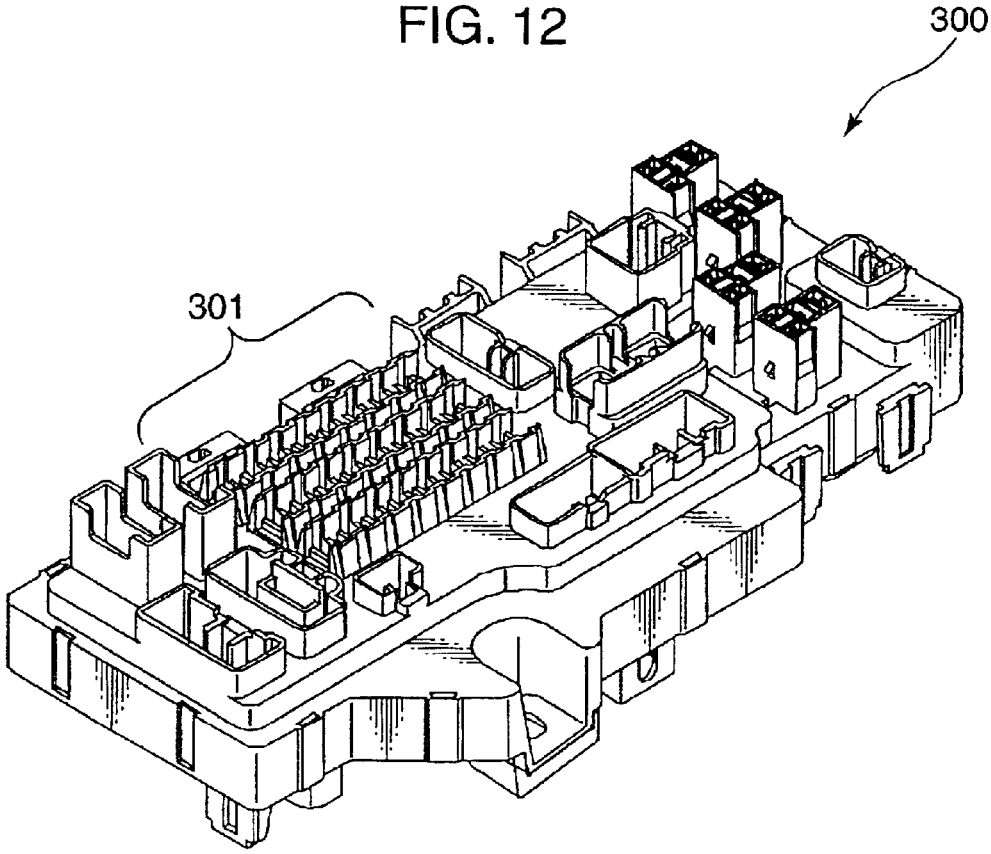
PRIOR ART FIG. 12
FIG. 12 is a perspective view showing an external configuration of a conventional electrical connection box.
Figure 13:
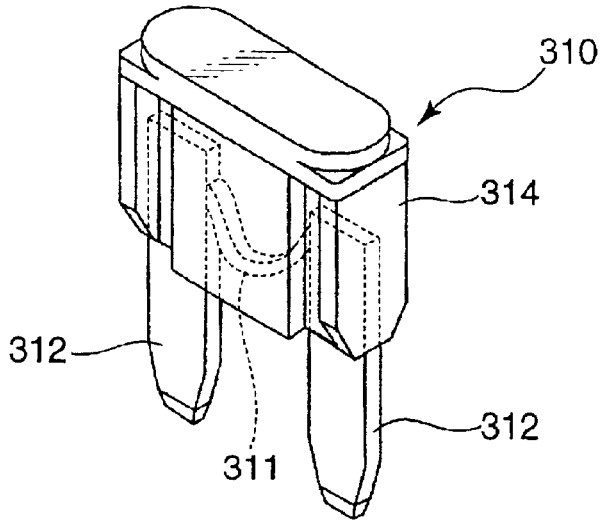
PRIOR ART FIG. 13
FIG. 13 is a perspective view showing an external configuration of a conventional fuse.
Figure 14:
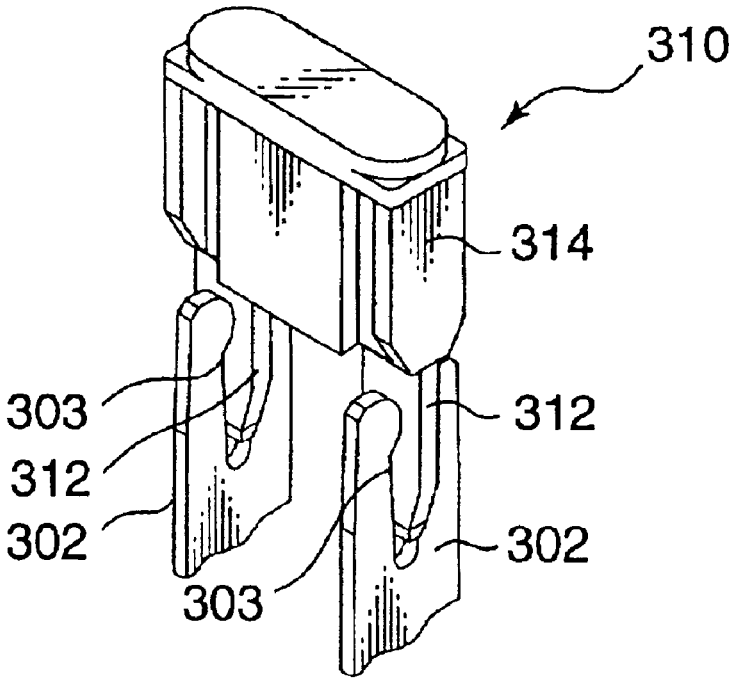
PRIOR ART FIG. 14
FIG. 14 is a perspective view showing a state where the conventional fuse is mounted into connection with a tab terminals.

In this completed fuse module, as shown in FIG. 8, the tab terminals 140 formed at leading ends of busbars are inserted into the forked inserting portions 112*a*, 122*a* provided at the second connecting portions 112, 122 upon being inserted through the tab terminal insertion holes 138*a*, 138*b*, thereby electrically connecting the tab terminals 140 with the second connecting portions 112, 122. At this time, each connection terminal (120*a*, 120*f*, 120*g*) having two or more second connecting portions 122 has at least one second connecting portion 122 connected with the tab terminal 140. It should be noted that the tab terminal is formed by bending one end of a busbar having the other end thereof connected with an electric circuit built in an electrical connection box and is, for example, as shown in FIGS. 10A to 11C. A tab terminal 140A shown in FIGS. 10A to 10C is formed by beveling corners at the longer sides of an end (upper end) of a flat plate, whereas a tab terminal 140B shown in FIGS. 11A to 11C is formed by beveling corners at all sides of an end (upper end) of a flat plate. The tab terminal may take another construction.

As described above, since the entire fuse module 101 is covered by the insulating fuse casing 130 in the second embodiment, no insulating member is required for each fuse 102, with the result that the fuse module can be made lighter. Further, it is sufficient to provide areas where the terminal sections 104, 105 of the fuses 102 and the first connecting portions 111, 121 of the connection terminals 110, 120 can be in contact with each other, a multitude of connection terminals and a multitude of fuses can be arranged in a compact construction. Furthermore, since the fuses 102 are arrayed at specified intervals along direction Y substantially normal to the spaced-apart direction of the terminal sections

104, 105 at the opposite sides of the fuses 102, the fuses and the connection terminals can be arranged at a high density.

In the second embodiment, the respective connection terminals 110, 120 to be connected with the terminal sections 104, 105 at the opposite sides of the fuses 102 are held in the casing main body 31 such that the first connecting portions 111, 121 thereof are arrayed along direction Y in which the fuses 102 are arrayed and located substantially on the same plane, i.e., substantially at the same height. Thus, the fuses 102 can be advantageously easily mounted, and the fuse module can be smaller since the fuses 102 are located substantially on the same plane. Since the spacing L3 between the terminal sections 104 and 105 at the opposite ends of the fuses 102 is constant among the fuses 102 and the spacing L4 (=L3) between the first connecting portions 111 and 121 to be connected with the terminal sections 104 and 105 is constant, the fuses 102 having different fusing characteristics can be used at desired positions, i.e., it does not matter where the fuses 102 are used. Further, the connection terminals 110, 120 are arranged in the direction of the rows H, I, J while being separated into the input side and the output side and the fuses 102 are electrically connected between suitable input-side connection terminals 120 and the output-side connection terminals 110. Since the connection terminals 110, 120 are orderly arrayed, maintenance can be easily made. Further, since the first connecting portions 121 of the input-side connection terminals (120*a*, 120*b*, 120*d*, 120*e*, 120*f*, 120*g*) extend in the direction of the rows H, I, J and are connected with the first connecting portions 111 of a plurality of output-side connection terminals 110 via the fuses 102, assembling of the input-side connection terminals 120 can be easier and the number thereof can be reduced. As a result, the construction of external circuits (e.g., busbar circuits) can be made simpler.

Further, since the second connecting portions 122 all project down and the tab terminals 140 are externally connected with the second connecting portions 122 via the tab terminal insertion holes 138*a*, 138*b* formed in the fuse casing 130, the fuse casing 130 having an internal circuitry in which the fuses 102 are connected with the connection terminals 110, 120 in a desired manner can be mounted into connection with the tab terminals 140 provided in the electrical connection box via the tab terminal insertion holes 138*a*, 138*b*, and desired second connecting portions 112, 122 and desired tab terminals 140 are connected at once, thereby remarkably improving an operability of mounting the fuses in the electrical connection box. Furthermore, the respective connection terminals 110, 120 can be mounted by inserting the second connecting portions 112, 122 into the connecting portion mount holes 136*a*, 136*b* formed in the casing main body 131. If one connecting portion mount hole 136*a* and one connecting portion mount 136*b* are formed in each recess 134 of the casing main body 131 as described above, the arrangement of the connection terminals 110, 120 and the used state of the connection terminals 120 having the first connecting portions 121 of various different lengths can be changed in a desired manner. Further, since the fuse casing 130 is comprised of the opening 131*a* and the cover 132 capable of detachably closing the opening 131*a*, the connection terminals 110, 120 and the fuses 102 may be mounted in a desired manner through the opening 131*a* with the cover 132 detached and then the cover 132 may be put to close the opening 131*a*. This leads to an improved operability.

Although the fuses 102 are arrayed in three rows H, I, J in the second embodiment, the present invention is not limited thereto. The fuses 102 may be arranged in one, two or more rows depending on the number thereof to be used.

Further, although the terminal sections of the fuses are mounted on the first connecting portions of the connection terminals mounted in the casing in the second embodiment, the present invention is not limited thereto. The connection terminals may be mounted later such that the terminal sections of the fuses placed at specified positions in the casing are covered by the first connecting portions.

Furthermore, the second connecting portions and the tab terminals are electrically connected with each other by inserting the tab terminals into the forked inserting portions provided at the second connecting portions in the second embodiment. However, according to the present invention, the forked inserting portions may be conversely formed at the tab terminals, and the second connecting portions and the tab terminals are electrically connected with each other by inserting the second connecting portions having no slit into the forked inserting portions.

The fuses themselves need not be insulated by the insulating members since a plurality of fuses are arranged inside the fuse casing. Thus, the fuse module can be made lighter by eliminating the need for the insulating members. Further, the opposite terminal sections need not be covered by the insulating member, and it is sufficient for the output terminal to have at least such a size as to be connectable with the tab terminal and for the input terminal to have at least such a size as to be connectable with the tab terminal and the shorting member. Thus, the terminal sections can be made smaller. As a result, the fuse module can be made smaller.

Further, since the entire fuse module is covered by the insulating fuse casing even when the connection terminals are used, it is not necessary to provide the insulating members for the respective fuses, thereby enabling the fuse module to be smaller. Further, it is sufficient to provide at least areas where the terminal sections of the fuses and the connecting portions of the connection terminals are in contact, a multitude of connection terminals and a multitude of fuses can be arranged in a compact construction.

As described above, an inventive fuse module comprises a plurality of fuses each having a fusing element and terminal sections at opposite ends of the fusing element, and a fuse casing for accommodating all of the plurality of fuses. The fuse casing is made of an insulating material, and formed with external terminal insertion holes.

One and the other of the terminal sections of each fuse accommodated in the fuse casing function as an input terminal and an output terminal, respectively. The respective output terminals are so arranged as to be electrically connectable with external terminals of busbars via external terminal insertion holes formed to penetrate the fuse casing from inside to outside. The respective input terminals are so arranged as to be electrically connectable with external terminals of the busbars via second external terminal insertion holes formed to penetrate the fuse casing from inside to outside.

Since a plurality of fuses are arranged inside the fuse casing in the inventive fuse module, it is not necessary to insulate the fuses themselves by insulating members and the fuse module can be made lighter by eliminating the use of the insulating members. Further, the input and output terminals of the respective fuses need not be covered by insulating members, and it is sufficient for the input terminals and the output terminals to have at least such sizes as to be connectable with the external terminals (tab terminals). Thus, the opposite terminal sections can be made smaller and, as a result, the fuse module can be made smaller.

Preferably, the respective fuses are plate-shaped and are vertically mounted in fuse mount holes individually provided therefor in a base portion of the fuse casing.

With this construction, since the fuses are individually mounted in the fuse mount holes formed in the insulating fuse casing, the respective fuses can be insulated from other fuses. Further, since the fuses are vertically mounted in the fuse mount holes, a mounting area can be made smaller, thereby enabling the fuse module to be even smaller.

Preferably, each fuse mount hole is formed such that a pair of terminal mounting portions in which the two terminal sections of the corresponding fuse are mounted and a fusing element mounting portion in which the fusing element of the corresponding fuse is mounted are horizontally aligned, and the width of the two terminal mounting portions is at least substantially equal to the thickness of the fuse.

With this construction, the fuses can be securely held without shaking at the terminal mounting portions located at the opposite ends of the fuses since the width of the opposite terminal mounting portions is substantially equal to the thickness of the fuses.

Preferably, spacing between the two terminal sections of each fuse is constant among the respective fuses.

With this construction, desired fuses can be mounted in the fuse mount holes and the fuses can be used without being chosen if their fuse capacities are same.

Preferably, the width of the fusing element mounting portions is larger than the thickness of the fuses.

With this construction, clearances are formed between the fusing element of each fuse mounted in the fuse mount hole and the fusing element mounting portion. Thus, the fuse can be easily taken out using these clearances.

Preferably, the input terminals are arrayed in the same row and an electrically conductive shorting member is further provided to simultaneously engage a plurality of input terminals.

With this construction, when the shorting member is engaged with the plurality of input terminals, the plurality of input terminals engaged are shorted with each other since the shorting member is electrically conductive. Thus, it is sufficient to connect at least one of the plurality of shorted input terminals with the tab terminal of the busbar, which leads to reduction in the number of the busbars and simplifies the construction of the busbars. Further, since the electrically conductive shorting member is engaged with the input terminals arrayed in the same row, the plurality of input terminals are simultaneously engaged and shorted, thereby improving an operability of mounting the shorting member.

Preferably, the shorting member includes a plurality of comb-shaped press-contact blades for engaging the plurality of input terminals while holding them from opposite sides.

With this construction, when the shorting member is so pushed that the respective input terminals are insertable into the comb-shaped press-contact blades, the respective comb-shaped press-contact blades and the respective input terminals are simultaneously engaged. Therefore, the input terminals can be shorted by a simple operation.

Preferably, the plurality of comb-shaped press-contact blades are provided at the same intervals.

With this construction, since the comb-shaped press-contact blades are provided at the same intervals in the shorting member, the shorting member can be used without choosing the input terminals to be shorted by arranging the input terminals at intervals in conformity with the arrangement intervals of the comb-shaped press-contact blades.

Preferably, the input terminals are arranged to face the outer side of the fuse casing, and the shorting member is inserted into the fuse casing from outside.

With this construction, since the shorting member is inserted into the fuse casing from outside, it is not necessary to provide the shorting member in a narrow space within the fuse casing and a shorting operation by the shorting member can be made easier.

Another inventive fuse module comprises a plurality of fuses each having a fusing element and terminal sections at opposite ends of the fusing element, a plurality of connection terminals including first connecting portions to be connected with the respective terminal sections and second connecting portions to be connected with external terminals, and an insulating fuse casing for accommodating all of the fuses. The insulating fuse casing is formed with a plurality of connection terminal holding portions for holding the plurality of connection terminals in a state that at least the first connecting portions are exposed. The terminal sections of the fuses are connected with the exposed first connecting portions. The second connecting portions are so arranged as to be electrically connectable with external terminals of busbars via external terminal insertion holes formed to penetrate the fuse casing from inside to outside.

Since the inventive fuse module is covered in the entirety by the insulating fuse casing, it is not necessary to provide an insulating member for each fuse, which enables the fuse module to be lighter. Further, since it is sufficient to provide at least areas where the terminal sections of the fuses and the connecting portions of the connection terminals are in contact, a multitude of connection terminals and a multitude of fuses can be arranged in a compact construction.

Preferably, the respective fuses are arrayed at specified intervals in a row direction substantially normal to a spaced-apart direction of the terminal sections at the opposite sides of the respective fuses.

With this construction, the fuses and the connection terminals can be arranged at a high density.

Preferably, the respective connection terminals to be connected with the terminal sections at the opposite sides of the fuses are held in the fuse casing such that the first connecting portions thereof are arrayed in the row direction in which the fuses are arrayed, and are located substantially on the same plane.

With this construction, since the first connecting portions are arrayed in the specified direction and at the same height, there is an advantage that the fuses can be easily mounted. In addition, since the fuses are located substantially on the same plane, the fuse module can be made smaller.

Preferably, spacing between the terminal sections at the opposite sides of each fuse is set equal among the respective fuses and spacing between the first connecting portions to be connected with the opposite terminal sections is also set equal.

With this construction, fuses having different fusing characteristics can be used at desired positions; it does not matter at which positions the fuses are used.

Preferably, the connection terminals are arrayed in the row direction while being separated into an input side and an output side, and each fuse is electrically connected between a suitable input-side connection terminal and a suitable output-side connection terminal.

With this construction, maintenance can be easily made since the connection terminals are orderly arrayed.

Preferably, the first connecting portions of at least part of the input-side connection terminals extend in the row direction and are connected with the first connecting portions of a plurality of output-side connection terminals via the fuses.

With this construction, since the number of the input-side connection terminals can be reduced, the assembling of the input-side connection terminals can be easier and the number thereof can be reduced, and the construction of external circuits (e.g., busbar circuits) can be made simpler.

Preferably, all the second connecting portions project in the same direction. With such second connecting portions, the external circuits can be connected with the respective connection terminals in one direction. More specifically, the external terminals are preferably connected with the second connecting portions from outside via external terminal insertion holes formed in the fuse casing.

With this construction, when the fuse casing having an internal circuitry in which the fuses are connected with the connection terminals in a desired manner is mounted into connection with the external terminals such as tab terminals provided in an electrical connection box via the external terminal insertion holes, all the second connecting portions and external terminals are connected at once. Contrary to this, in the case of a conventional structure for mounting fuses into an electrical connection box, the fuses need to be mounted one by one into connection with a multitude of tab terminals provided in a fuse mounting section of the electrical connection box by insertion, leading to a poor fuse mounting operability. However, the inventive construction can remarkably improve an operability of mounting the fuses into the electrical connection box.

Further, in the inventive fuse module, the respective connection terminals may be mounted by inserting the second connecting portions into connecting portion mount holes formed in the fuse casing.

With this construction, the connecting portion mount holes are formed in the fuse casing beforehand, and the connection terminals can be mounted later on by inserting the second connecting portions into the connecting portion mount holes. If the connecting portion mount holes are provided at many positions, the arrangement of the connection terminals and the used state of the connection terminals having the first connecting portions of various different lengths can be changed in a desired manner.

Preferably, the fuse casing includes an opening through which the connection terminals and the fuses are mounted, and a cover detachably mountable to close the opening.

With this construction, the connection terminals and the fuses may be mounted through the opening with the cover detached and then the cover may be put to close the opening. This leads to a good operability.

This application is based on patent application No. 2000-382673 and 2001-3340 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A fuse module comprising:

a plurality of fuse pieces, each including a plate-shape input terminal, a plate-shape output terminal, and a fusing element connected between the output and input terminals;

a fuse casing made of an insulating material and including a plurality of fuse mount holes that separately receive entire bodies of the fuse pieces; and tab terminals incorporated in the fuse casing and electrically connected with the output and input terminals respectively, wherein the each of the fuse pieces is vertically mounted in the fuse mount hole and the tab terminals engage corresponding plate-shape output or input terminals and wherein each of the fuse mount holes includes a first slit for receiving the input terminal, a second slit for receiving the output terminal, and a hole section for receiving the fusing element, and the width of the slits is substantially equal to the thickness of the output and input terminals.

2. A fuse module comprising:

a plurality of fuse pieces, each including a plate-shape input terminal, a plate-shape output terminal, and a fusing element connected between the output and input terminals;

a fuse casing made of an insulating material and including a plurality of fuse mount holes that separately receive entire bodies the fuse pieces; and tab terminals incorporated in the fuse casing and electrically connected with the output and input terminals respectively, a plurality of input connection terminals interposed between and engage the input terminals and tab terminals, and an output connection terminal interposed between and engage the output terminals and the tab terminals.

3. A fuse module comprising:

a plurality of fuse pieces, each including a plate-shape input terminal, a plate-shape output terminal, and a fusing element connected between the output and input terminals;

a fuse casing made of an insulating material and including a plurality of fuse mount holes that separately receive the fuse pieces; and tab terminals incorporated in the fuse casing and electrically connected with the output and input terminals respectively, wherein the each of the fuse pieces is vertically mounted in the fuse mount hole and the tab terminals engage corresponding plate-shape output and input terminals, and each of the fuse mount holes includes a first slit for receiving the input terminal, a second slit for receiving the output terminal, and a hole section for receiving the fusing element, and the width of the slits is substantially equal to the thickness of the output and input terminals.

4. A fuse module according to claim 3, wherein the fuse mount holes are arranged in a row with a same pitch.

5. A fuse module according to claim 4, wherein the width of the hole section is larger than that of the slits.

6. A fuse module according to claim 5, further comprising an electrically shorting member engaging the input terminals to be electrically connected therewith.

7. A fuse module according to claim 6, wherein the electrically shorting member includes a plurality of press contact blades forming a comb shape, each two of the blades forming a pair to engage the input terminal on opposite sides thereof.

8. A fuse module according to claim 7, wherein the pairs of press contact blades are arranged at same pitches.

9. A fuse module according to claim 7, wherein the fuse casing includes a top opening where the plurality of fuse mounts holes are formed, and wherein the busbars extend along the bottom of the fuse casing and the tab terminals extend upward from the busbar, a shorting member receiving slit is formed on the side of the fuse casing to receive the shorting member which extends through the shorting member receiving slit and engage the input terminals at right angle with the input terminal.

10. A fuse module according to claim 9, wherein each of the tab terminals has forked ends between which input and output terminal of the fuse piece is sandwiched.

11. A fuse module comprising:

a plurality of fuse pieces, each including a plate-shape input terminal, a plate-shape output terminal, and a fusing element connected between the output and input terminals;

a fuse casing made of an insulating material and including a plurality of fuse mount holes that separately receive the fuse pieces;

tab terminals incorporated in the fuse casing and electrically connected with the output and input terminals respectively, and a plurality of input connection terminals interposed between and engaging in input terminals and tab terminals, and an output connection terminal interposed between and engaging the output terminals and the tab terminals.

12. A fuse module according to claim 11, wherein the fuse pieces are substantially horizontally disposed on the fuse casing and arranged in a row at specified intervals, with the direction from the input to output terminals of the fuse pieces being normal to the direction of the row.

13. A fuse module according to claim 12, wherein the input connection terminals are separated from one another and are arranged in a row to be in contact with respectively corresponding input terminals.

14. A fuse module according to claim 13, wherein the input terminals and the input connection terminals are arranged at equal pitches.

15. A fuse module according to claim 14, wherein the output connection terminal extends along the row to be in contact with a plurality of output terminals.

16. A fuse module according to claim 15, wherein each of the input connection terminals includes a horizontal portion to be in contact with the input terminal, and a vertically extending portion to engage the tab terminal, and the output terminals, and a vertically extending portion to engage the tab terminal.

17. A fuse module according to claim 16, wherein the fuse casing includes a side wall extending above the fuse pieces mounted in the fuse case, and further comprising a cover for enclosing the fuse pieces within the fuse casing.

18. A fuse module according to claim 17, wherein each of the vertically extending portions of the input and output connection terminals has forked ends between which the tab terminal is sandwiched.

* * * * *